US006398459B1

(12) United States Patent
Vreeland

(10) Patent No.: US 6,398,459 B1
(45) Date of Patent: Jun. 4, 2002

(54) APPARATUS FOR INSTALLING A SILT FENCE

(76) Inventor: Gregory M. Vreeland, 1217 Lyons Rd., Centerville, OH (US) 45458

( * ) Notice: Subject to any disclaimer, the term of this patent is extended or adjusted under 35 U.S.C. 154(b) by 0 days.

(21) Appl. No.: 09/884,386

(22) Filed: Jun. 19, 2001

(51) Int. Cl.[7] ..... E02D 17/20; E02F 5/10

(52) U.S. Cl. ..... 405/302.6; 405/116; 405/302.4; 37/367; 37/466

(58) Field of Search ..... 405/116, 258.1, 405/302.6, 302.7, 176, 180, 183, 184.4, 302.4, 157; 37/367, 466

(56) References Cited

U.S. PATENT DOCUMENTS

| | | | | | |
|---|---|---|---|---|---|
| 3,327,484 | A | * | 6/1967 | Launder et al. | 405/157 |
| 3,339,369 | A | * | 9/1967 | Ryan | 405/157 |
| 4,597,693 | A | * | 7/1986 | McQuary et al. | 405/176 |
| 4,705,427 | A | | 11/1987 | Atkins et al. | 405/36 |
| 4,829,915 | A | * | 5/1989 | Ahm | 405/178 |
| 4,832,531 | A | * | 5/1989 | Paulovits | 405/176 |
| 5,246,312 | A | * | 9/1993 | Taki | 405/129.75 |
| 5,526,759 | A | * | 6/1996 | Cox | 405/176 |
| 5,915,878 | A | | 6/1999 | Carpenter | 405/38 |
| 6,053,665 | A | | 4/2000 | Richardson | 405/302.6 |
| 6,158,923 | A | | 12/2000 | Wheeler et al. | 405/116 |

* cited by examiner

*Primary Examiner*—Robert E. Pezzuto
*Assistant Examiner*—Tara L. Mayo
(74) *Attorney, Agent, or Firm*—Jacox, Meckstroth & Jenkins

(57) ABSTRACT

A tractor carries a vertically adjustable frame supporting a horizontal shaft for a supply roll of silt fence fabric. A flat vertical plow blade is mounted on the frame and has a front surface and a rear surface. A thinner flat vertical fin is supported directly behind the plow blade by a horizontal fabric guide bar attached to the frame. The fin has a downwardly and rearwardly curved front surface for receiving an intermediate portion of the fabric directed around the guide bar and for folding an edge portion of the fabric into the slot formed by the plow blade. After the ground is compacted by a tractor wheel, steel rebar stakes are driven into the ground, and the fabric is attached to wood or plastic cap members mounted on the stakes.

14 Claims, 3 Drawing Sheets

APPARATUS FOR INSTALLING A SILT FENCE

BACKGROUND OF THE INVENTION

The present invention relates to a machine or apparatus for installing a longitudinal edge portion of a fabric silt fence into the ground so that a major portion of the fabric projects above the ground and is supported by longitudinally spaced vertical stakes. Various forms of such machines or apparatus are disclosed in U.S. Pat. No. 4,705,427, U.S. Pat. No. 5,915,878, U.S. Pat. No. 6,053,665 and U.S. Pat. No. 6,158,923. The '427 patent discloses apparatus having a plow shoe to form an open furrow into which an edge portion of a perforated film is rolled into the furrow by a wheel, after which the ground is plowed back into the furrow with a disc. In the '878 patent, a rotary disc cuts a slot into the ground, and a rotary wheel feeds a rope from a supply roll into the bottom of the slot along with an edge portion of a fabric silt fence wrapped around the rope. The frame supports a roll of silt fence along with a spool of rope. The '665 patent discloses apparatus for installing a silt fence fabric having an enlarged edge portion which is fed through a slotted channel within the back of a blade having a vertical ground cutting edge. The '923 patent discloses a machine for forming a trench within the ground, inserting a silt fence fabric while driving preattached stakes into the ground and then backfilling the trench.

SUMMARY OF THE INVENTION

The present invention is directed to an improved and simplified machine or apparatus for forming a narrow slot within the ground and folding a lower edge portion of a silt fence fabric directly into the narrow slot without requiring a silt fence fabric having an enlarged lower edge portion or the use of a continuous rope to enlarge the lower edge portion of the fabric. The apparatus of the invention also uses commercially available silt fence material or fabric and provides for conveniently and quickly compacting the soil adjacent the narrow slot which receives the folded edge portion of the silt fence.

In accordance with one embodiment of the invention, the apparatus includes a fabricated steel frame having a three point hitch for mounting the frame on the hydraulically controlled and rear projecting lift arms of a conventional tractor. The frame supports a flat vertical plow blade having a downwardly and forwardly curved front surface and a downwardly and rearwardly curved rear surface. The frame also includes a pair of parallel spaced horizontal arms or rails which support an adjustable shaft extending through the tubular core of a supply roll of the silt fence fabric.

A horizontal fabric guide rod or bar is positioned above the rear surface of the plow blade and supports a flat vertical fin behind the plow blade and having a downwardly and rearwardly curved front surface which cooperates with the rear surface of the plow blade to define a curved slot for receiving an intermediate portion of the fabric web directed from the supply roll around the fabric guide rod or bar. As the plow blade is pulled through the soil or ground, it forms a narrow vertical slot, and the fin cooperates with the ground for progressively folding and inserting an edge portion of the fabric web and with the upper portion of the fabric web overlying the ground surface. A wheel of the tractor is then driven over the ground where the folded edge portion of the fabric web is inserted to compact the ground firmly around the folded edge portion and thereby lock the edge portion into the ground. A series of steel rebar stakes are driven into the ground adjacent the inserted folded edge portion of the fabric, and a cap member is mounted on the upper end portion of each rebar stake for attaching the upper portion of the fabric to the stakes to form the silt fence.

Other features and advantages of the invention will be apparent from the following description, the accompanying drawings and the appended claims.

DESCRIPTION OF THE PREFERRED EMBODIMENT

Figure 1:
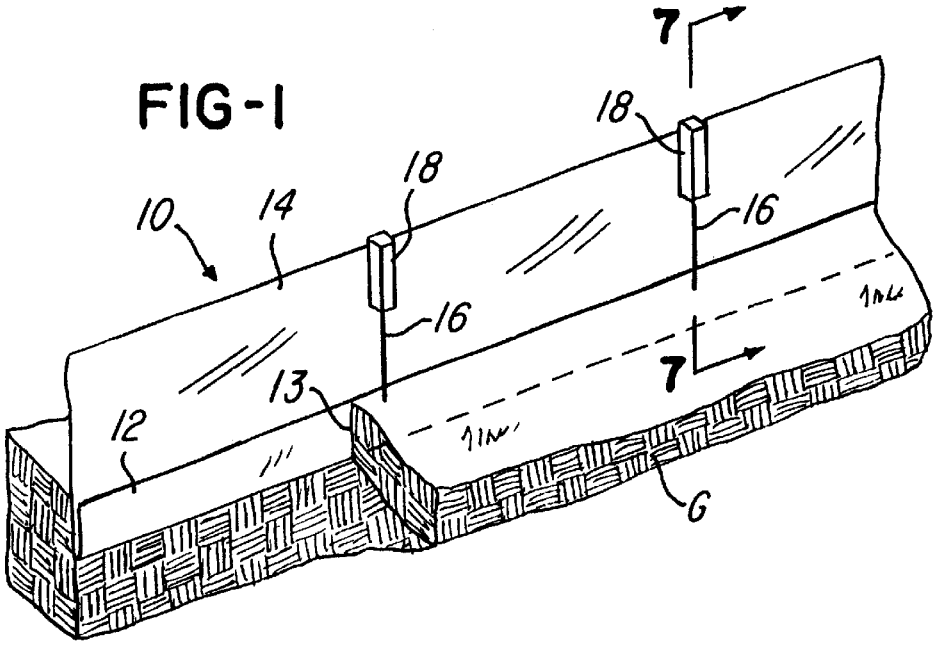
FIG. 1 is a fragmentary perspective view of a silt fence installed within the ground and supported in accordance with the invention.
Figure 7:
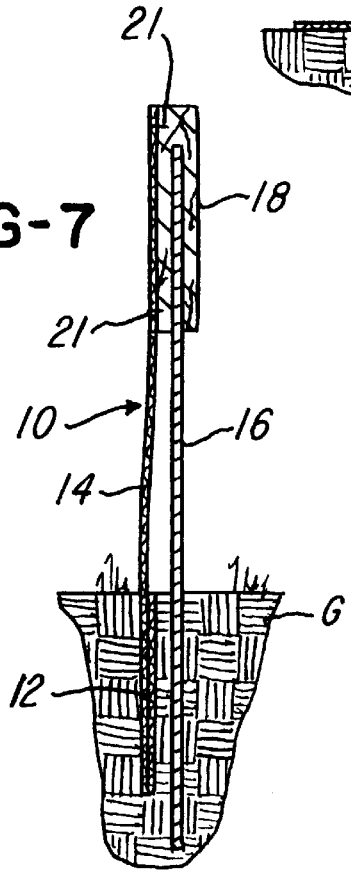
FIG. 7 is a vertical section of the silt fence and a support stake constructed and installed in accordance with the invention, taken generally on the line 7—7 of FIG. 1.

FIG. 1 illustrates a woven fabric silt fence 10 which has a lower folded edge portion 12 buried within a slot 13 formed in the soil or ground G. Preferably the folded edge portion 12 has a width in the range of 6" to 8", and an upper portion 14 of the fabric silt fence 10 projecting above the ground is on the order of 16" high. The upper portion 14 of the silt fence is retained in a generally vertical position by a series of longitudinally spaced support stakes 16 (FIGS. 1 & 7), preferably in the form of sections of steel reinforcing rod or bar, commonly referred to as a "rebar". As shown in FIG. 7, a cap member 18, in the form of a wood 2"×2", has a hole within its lower end for receiving the upper end portion of a rebar stake 16, and the upper portion 14 of the silt fence 10 is attached to each cap member 18 on each stake 16 by a plurality of staples 21. The stakes 16 are driven into the ground at longitudinally spaced intervals, for example, ten feet, along the silt fence 10 after the folded lower edge portion 12 of the silt fence is inserted into the ground and after the ground is compacted. Each cap member 18 is mounted or installed on the corresponding stake 16 after the stake is driven into the ground adjacent the silt fence, as shown in FIG. 7.

Figure 2:
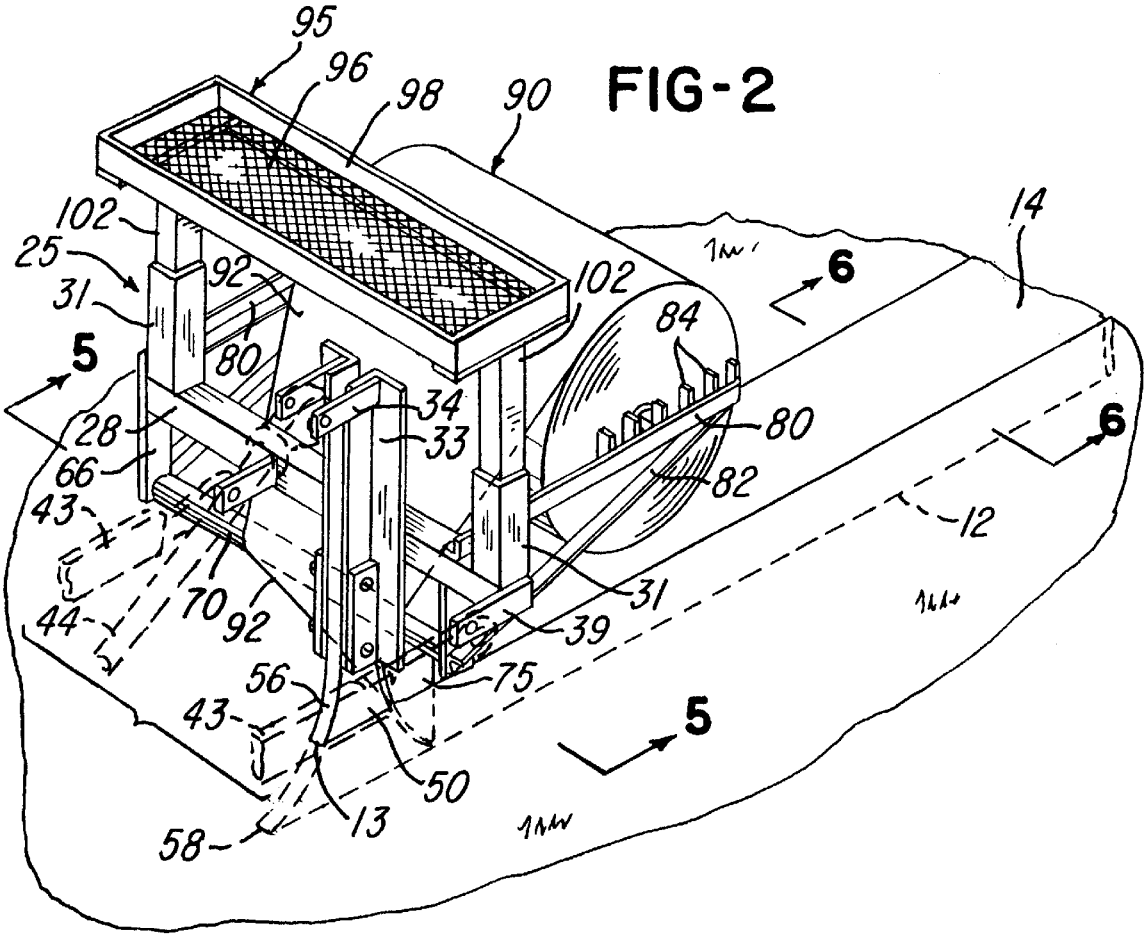
FIG. 2 is a perspective view of apparatus constructed in accordance with the invention for receiving a supply roll of silt fence and for installing the silt fence shown in FIG. 1.

Referring to FIGS. 2–5, the folded lower edge portion 12 of the silt fence 10 is inserted into the soil or ground G by an apparatus or machine 25 which includes a fabricated steel frame 26 having a square cross tube 28 with a pair of square vertical socket tubes 31 welded to opposite end portions of the cross tube 28. A pair of parallel spaced vertical angle members 33 are also welded to the cross tube 28, and a pair of horizontal hitch bars 34 are welded to the upper end portions of the angle members 33 and have horizontally aligned holes 36. A set of forwardly projecting hitch bars 38 and 39 are also welded to the cross tube 28 and have horizontally aligned holes 41. As shown in FIG. 2, the holes 36 and 41 are adapted to receive pivot pins to form a conventional three point hitch for attaching the frame 26 to a pair of draft links 43 connected by lift links to hydraulically controlled lift arms and to a center or top link rod 44, all projecting rearwardly from a conventional small farm tractor (not shown).

A flat vertical plow blade 50 (FIGS. 3 & 4) has a uniform thickness, for example, one inch, and includes an upper portion 51 sandwiched between the angle members 33 and secured by a pair of bolts 53 and a pair of reinforcing bars 54. The plow blade 50 has a downwardly and forwardly curved front surface 56 which cooperates with a flat bottom surface to form a leading cutting edge 58. The plow blade 50 also has a downwardly and rearwardly curved rear surface 62 (FIG. 4) which provides the plow blade with a generally inverted Y configuration. A set of downwardly projecting plates or brackets 66 (FIG. 3) and 68 (FIG. 4) are welded to the cross tube 28 of the frame 26 and support a horizontal guide tube or bar 70 having opposite ends welded to the bracket 66 and 68. A bracket or plate 72 is welded to the guide bar 70 at a location spaced inwardly from the end of the bar, and a pair of bolts 73 connect the bracket 68 to a vertical fin 75 having a downwardly and rearwardly curved front surface 76. The fin 75 is thinner than the plow blade 50, for example, on the order of ¼ inch, and the curved front surface 76 on the fin 75 cooperates with the curved rear surface 62 on the plow blade 50 to define a downwardly and rearwardly extending curved slot 78 having a uniform width of about ¼ inch.

A pair of parallel spaced elongated horizontal arms or rails 80 have forward end portions welded to the cross tube 28 of the frame 26, then each arm is reinforced by an inclined angle brace member 82 having a rearward end portion welded to the corresponding rail 80 and a forward end portion welded to the corresponding bracket 66 and 68. A series of parallel spaced vertical divider plates 84 are welded to each rail 80 to define a series of pockets, and the pockets receive opposite end portions of a substantially horizontal support rod or axle 86. The axle 86 extends through the center cylindrical core of a supply roll 90 of the fabric silt fence 10. A web 92 of the fabric silt fence is coiled into the roll 90 and has a width of about thirty inches, but the apparatus may be constructed to handle a wider or narrower web.

Referring to FIG. 2, a rectangular tray 95 has an expanded metal bottom 96 surrounded by a rectangular metal frame 98, and the tray 95 is supported above the tubular cross member or tube 28 by a pair of vertical square posts 102 which telescope into the square socket tubes 31 to provide for conveniently removing the tray 95. The tray 95 supports and carries a supply of rebar stakes 16 and a supply of cap members 18 so that they are conveniently accessible during installation of the silt fence 10.

Figure 6:
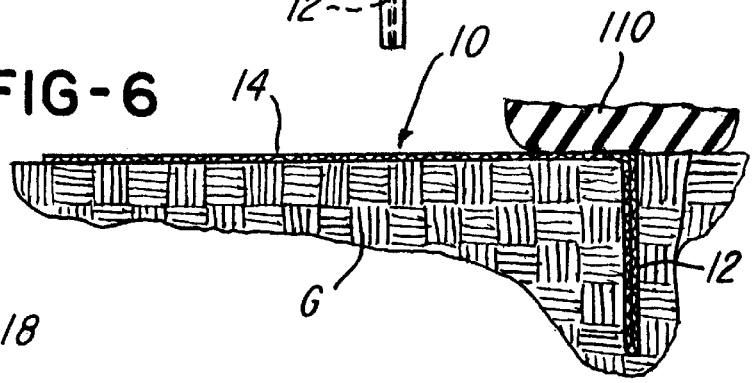
FIG. 6 is a fragmentary section through the ground after a folded edge portion of the silt fence fabric has been inserted, taken generally on the line 6—6 of FIG. 2.

In operation of the machine or apparatus 25, when the frame 26 is lowered by the hydraulically controlled draft links 43 on the tractor, the plow blade 50 cuts into the ground to form the narrow slot 13 as the tractor moves forwardly. The silt fence web 92 is directed from the supply roll 90 around the guide tube or bar 70, and an intermediate portion of the web is directed through the slot 78 so that the fin 75 and the ground cause the web to fold and form the folded edge portion 42 within the narrow slot formed by the plow blade 50, as shown in FIG. 2. As the folded edge portion 12 of the silt fence web 92 is inserted or fed into the slot 13 within the ground, the upper portion 14 of the silt fence web 92 overlies the ground, as also shown in FIG. 2. After the folded edge portion 12 of a desired length of the fabric silt fence 10 is installed, the apparatus 25 is elevated by the hydraulically controlled arms 43, the fabric silt fence web 92 is severed behind the apparatus, and the tractor is driven back over the silt fence so that a tractor wheel 110 (FIG. 6) compacts the earth or ground on both sides of the folded edge portion 12 of the silt fence, thereby locking the folded edge portion into the ground. As mentioned above, the rebar stakes 16 are then driven into the ground adjacent the silt fence 10 at longitudinally spaced intervals, the wood cap members 18 are mounted on the stakes, and the upper portion 14 of the silt fence 10 is attached or stapled to the wood cap members 18.

From the drawings and the above description, it is apparent that a silt fence installation machine or apparatus constructed in accordance with the present invention provides desirable features and advantages. As one feature, the apparatus is simple in construction without any moving parts and is dependable in operation so that the lower folded edge portion 12 has a substantially uniform width and is inserted by the fin 75 directly into the slot 13 formed within the ground by the slightly thicker plow blade 50. The plow blade 50 may also be conveniently removed and replaced in the event the plow blade is damaged, simply by removing the bolts 53, and the fabric folding fin 75 may also be conveniently removed and replaced by removing the bolts 73 if it becomes damaged.

Figure 3:
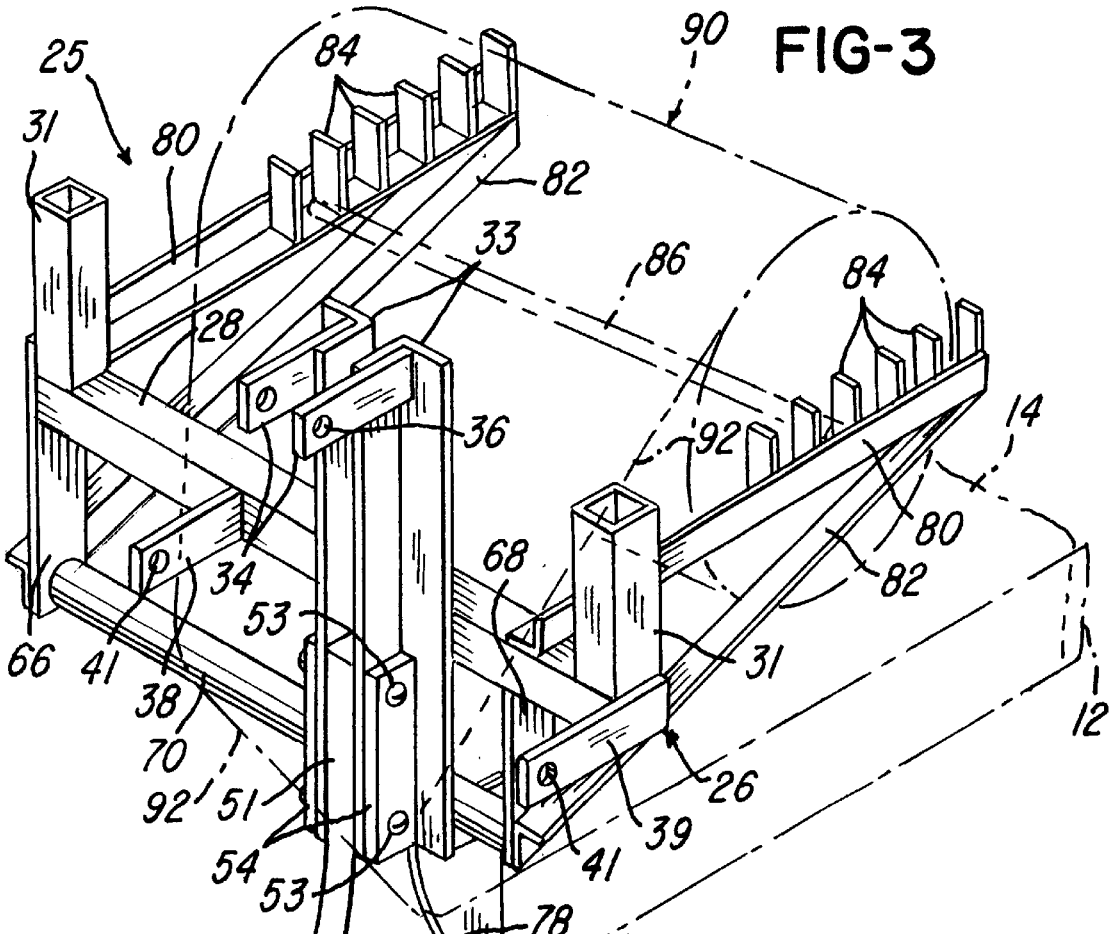
FIG. 3 is a larger perspective view of the apparatus with a portion removed and with the silt fence and its supply roll shown in phantom.
Figure 4:
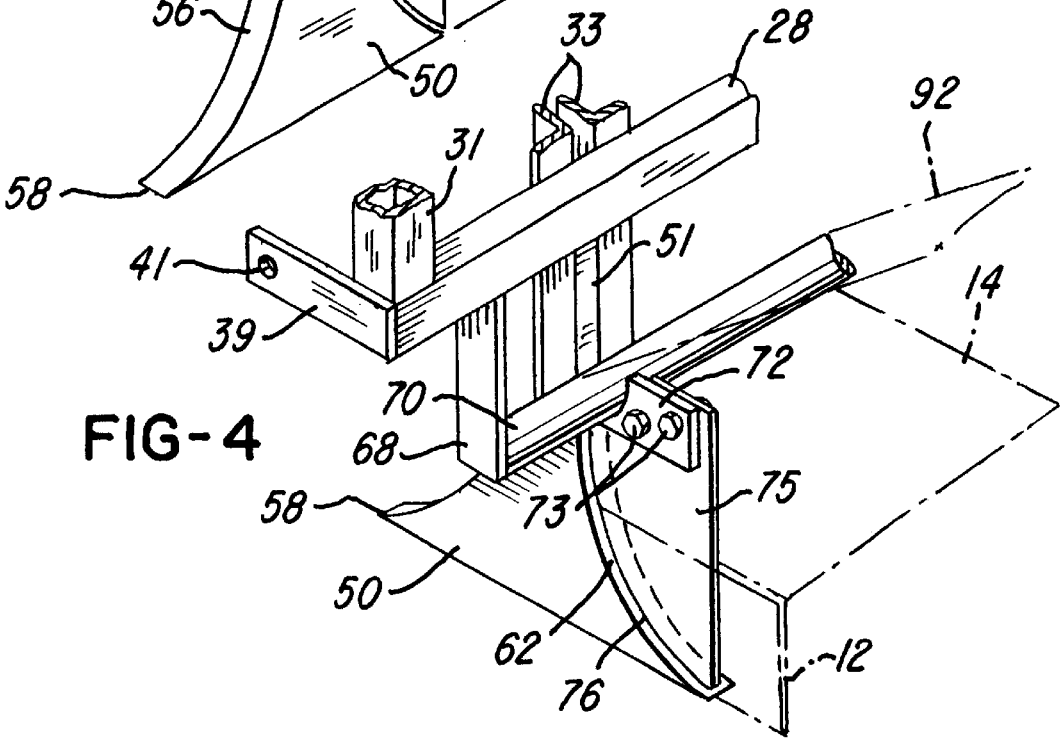
FIG. 4 is an enlarged fragmentary perspective view of a portion of the apparatus shown in FIG. 3.
Figure 5:
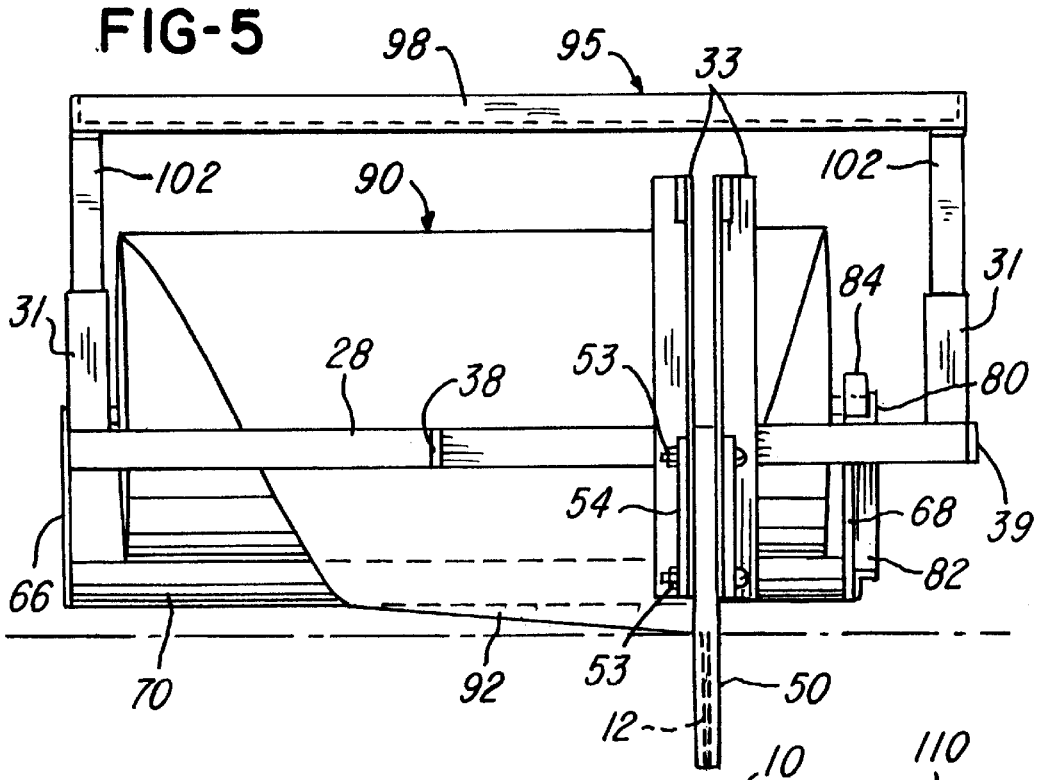
FIG. 5 is a front elevational view of the apparatus, taken generally on the line 5—5 of FIG. 2.

The tabs or plates 84 on the roll support arms or rails 80 also permit the appartus to handle rolls 90 of different sizes or diameters, and the roll 90 may be shifted forwardly as the roll becomes smaller so that the fabric web 92 engages the guide bar 70 at substantially the same angle regardless of the size of the roll. This provides for producing a folded edge portion 12 having a substantially uniform width as the edge portion 12 is inserted into the slot 13 within the ground by the fin 75. With some rolls of silt fence, it is also desirable to position the support rod or axle 86 at a slight angle or skewed relative to the cross tube 28, as shown in FIG. 3, to assure that the folded edge portion 12 has a uniform width within the ground.

Another feature is provided by the the steel rebar stakes 16 and the cap members 18 since the rebar stakes are more easily inserted into the ground and do not break or decay, as do conventional 2"×2" wood stakes. It is also within the scope of the invention to form each of the cap members 18 with an injection molded plastic body which clips or sockets onto a stake 16 and also clips onto the upper portion 14 of the fabric silt fence 10. The apparatus of the invention may also be mounted on other vehicles, for example, on the lower portion of a bulldozer blade directly in front of an endless track which compacts the soil after the apparatus inserts the lower folded edge portion of the silt fence. The hydraulically actuated pivotal arms on the back of the bulldozer may then be used for pressing the wood or rebar stakes into the ground.

While the form of apparatus herein described and the method of installing a silt fence constitute a preferred embodiment of the invention, it is to be understood that the invention is not limited to this precise form of apparatus and method, and that changes may be made therein without departing from the scope and spirit of the invention as defined in the appended claims.

What is claimed is:

1. Apparatus for inserting a longitudinal edge portion of a flexible silt fence material into the ground, comprising a frame adapted to be moved by a tractor along the ground, a support on said frame for supporting a supply roll of silt fence material having a predetermined width, a generally vertical plow blade mounted on said frame and having a forwardly facing front surface for cutting a slot within the ground in response to movement of the frame along the ground, said plow-blade having a rearwardly facing rear surface, a generally horizontal material guide bar supported by said frame and disposed above said rear surface of said plow blade, a generally vertical material guide fin supported by said frame rearwardly of said rear surface of said plow blade and having a downwardly and rearwardly curved front surface for receiving an intermediate portion of the silt fence material directed around said material guide bar, and said guide fin being spaced between opposite end portions of said guide bar for progressively folding the intermediate portion of the silt fence material and for guiding a folded edge portion of the material into the slot formed within the ground by said plow blade.

2. Apparatus as defined in claim 1 wherein said plow blade is substantially flat and has a generally uniform thickness, and said guide fin is substantially flat and has a generally uniform thickness smaller than said thickness of said plow blade.

3. Apparatus as defined in claim 1 wherein said opposite end portions of said material guide bar are attached to said frame, and said material guide fin is supported by an intermediate portion of said guide bar.

4. Apparatus as defined in claim 1 wherein said frame includes generally horizontal parallel rails spaced for receiving the supply roll therebetween, and said rails have horizontally spaced positions for receiving opposite end portions of a generally horizontal support shaft forming said support for the supply roll.

5. Apparatus as defined in claim 1 wherein said frame includes a three point hitch for supporting said frame with vertically moveable arms of the tractor.

6. Apparatus as defined in claim 1 in combination with a plurality of metal concrete-reinforcing bars forming a corresponding plurality of stakes for supporting an upper portion of the silt fence material in a vertical position and a cap member mounted on each said stake for attaching the upper portion of the silt fence material.

7. Apparatus as defined in claim 6 wherein each of said cap members comprises an elongated wooden block having a longitudinally extending hole for receiving the corresponding said stake.

8. Apparatus as defined in claim 1 wherein said frame supports a horizontal tray above said support for the supply roll for supporting a plurality of stakes adapted to be driven into the ground adjacent the silt fence material.

9. Apparatus for inserting a longitudinal edge portion of a flexible silt fence material into the ground, comprising a frame adapted to be moved by a tractor along the ground, spaced support rails on said frame for supporting therebetween a supply roll of silt fence material having a predetermined width, a generally vertical plow blade mounted on said frame and having a forwardly and downwardly curved front surface for cutting a slot within the ground in response to movement of the frame along the ground, said plow blade having a downwardly and rearwardly curved rear surface, a generally horizontal material guide bar supported by said frame and disposed above said rear surface of said plow blade, a generally vertical material guide fin supported by said guide bar above said rear surface of said plow blade and having a downwardly and rearwardly curved front surface cooperating with said rear surface of said plow blade to define a curved slot for receiving an intermediate portion of the silt fence material directed around said material guide bar, and said guide fin being spaced between opposite end portions of said guide bar for progressively folding the intermediate portion of the silt fence material and for guiding a folded edge portion of the material into the slot formed within the ground by said plow blade.

10. Apparatus as defined in claim 9 wherein said plow blade is substantially flat and has a generally uniform thickness, and said guide fin is substantially flat and has a generally uniform thickness smaller than said thickness of said plow blade.

11. Apparatus as defined in claim 10 wherein said plow blade has a thickness of about one inch, and said guide fin has thickness of about one quarter inch.

12. Apparatus as defined in claim 9 wherein said opposite end portions of said material guide bar are attached to said frame, and said material guide fin is removably mounted on an intermediate portion of said guide bar.

13. Apparatus as defined in claim 9 wherein said rails have horizontally spaced positions for receiving opposite end portions of a generally horizontal support shaft positioned to support for the supply roll.

14. Apparatus as defined in claim 9 wherein said frame includes a three point hitch for supporting said frame with vertically moveable arms of the tractor.

* * * * *